United States Patent [19]

McDermott et al.

[11] Patent Number: 4,677,533

[45] Date of Patent: Jun. 30, 1987

[54] LIGHTING FIXTURE

[76] Inventors: Julian A. McDermott, 1639 Stephen St., Ridgewood, N.Y. 11227; Kevin McDermott, 196 Phillips Dr., Hampstead, Md. 21074

[21] Appl. No.: 647,480

[22] Filed: Sep. 5, 1984

[51] Int. Cl.[4] ..... F21V 23/00

[52] U.S. Cl. ..... 362/240; 362/800

[58] Field of Search ..... 362/231, 227, 230, 234, 362/240, 246, 252, 800, 801, 98, 250, 311, 157, 184, 251

[56] References Cited

U.S. PATENT DOCUMENTS

| | | | |
|---|---|---|---|
| 322,496 | 7/1885 | Stanley, Jr. | 362/227 |
| 2,299,008 | 10/1942 | De Lisle | 362/98 |
| 3,283,136 | 11/1966 | Dinkler et al. | 362/231 |
| 3,379,869 | 4/1968 | Dorman | 362/231 |
| 3,539,801 | 11/1970 | Bobrick | 362/240 |
| 3,805,049 | 4/1974 | Frank et al. | 362/231 |
| 4,142,801 | 3/1979 | Calder et al. | 362/231 |
| 4,254,453 | 3/1981 | Monyard et al. | 362/240 |
| 4,271,408 | 6/1981 | Teshima et al. | 362/240 |
| 4,314,318 | 2/1982 | Dana | 362/301 |

OTHER PUBLICATIONS

Powerstat, Light Dimming Equipment, The Superior Electric Company, Bristol, Conn., U.S.A.

*Primary Examiner*—Craig R. Feinberg
*Assistant Examiner*—David A. Okonsky
*Attorney, Agent, or Firm*—Kenyon & Kenyon

[57] ABSTRACT

A reading lamp is constructed with electronic lamps which offer an opportunity to provide a variety of colors and shades of white light with a minimum of emitted heat. The electronic lamps can be disposed in an alternating pattern about an incandescent lamp or concentric rings of electronic lamps of different colors can be provided.

23 Claims, 8 Drawing Figures

Fig. 1.
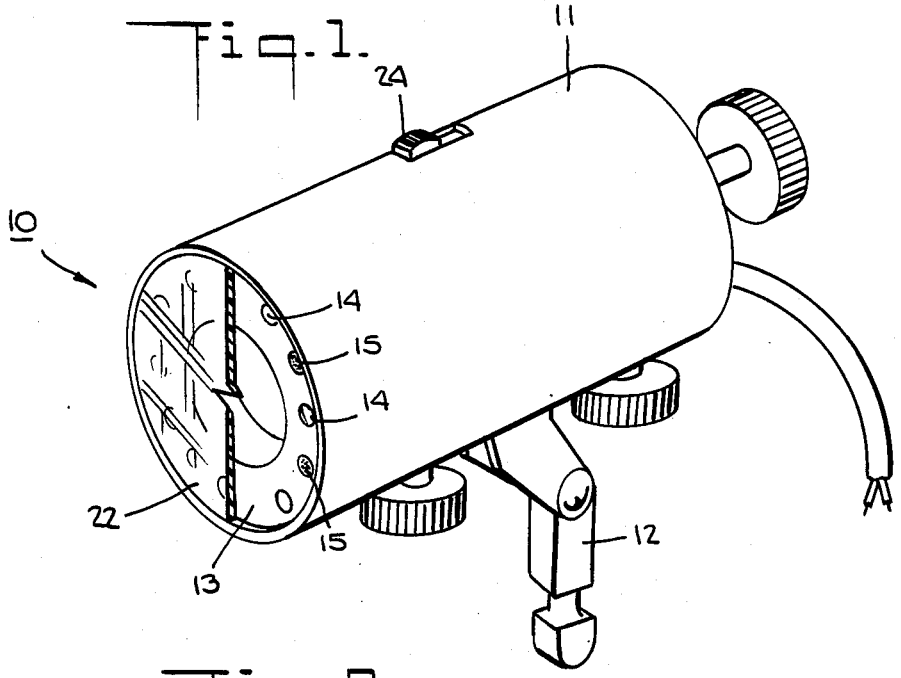
Fig. 2.
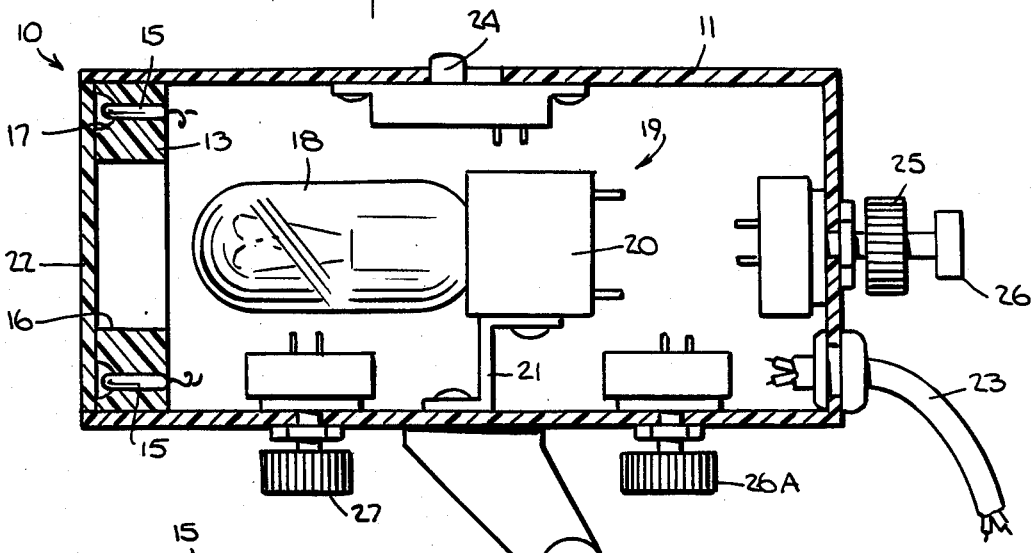
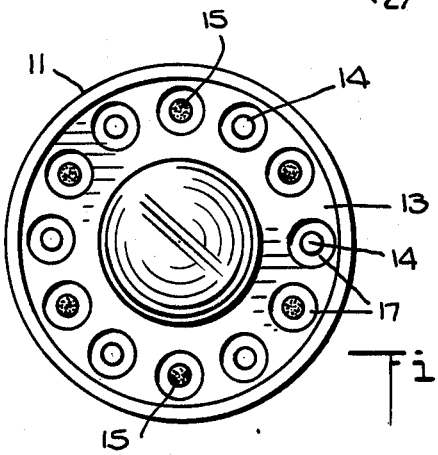
Fig. 3.
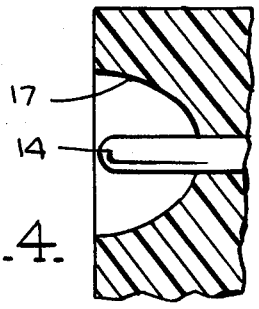
Fig. 4.

LIGHTING FIXTURE

This invention relates to a lighting fixture. More particularly, this invention relates to a reading lamp. Still more particularly, this invention relates to a lamp capable of producing multiple colors.

As is known, reading lamps such as cockpit lamps, desk lamps and the like generally include a projector which is mounted on an adjustable arm of some type. Such lamps have an advantage of allowing a light to be brought close to an object to be viewed and to the most advantageous position. However, heat can become a problem in that as the projector is moved closer to the head of a user there is a danger of personal burns, particularly, if the lamp is compact.

It is also known that many reading lamps employ an incandescent lamp in order to provide a high intensity light. However, such lamps can produce a relatively large amount of glare from an illuminated surface due to the intensity of the lamp. While such lamps can be provided with filters to reduce the glare, this requires additional expense and makes use of the lamps somewhat cumbersome.

Accordingly, it is an object of the invention to provide a reading lamp which can be used at relatively close range without the generation of significant heat.

It is another object of the inventiont o provide a lamp which can emit light in a range of color with a minimum production of heat.

It is another object of the invention to provide a lighting fixture wherein light of multiple colors can be provided at selected intensities without a need for filters.

It is another object of the inventionto provide a reading lamp which can provide color discrimination for the reading of maps and the like materials.

It is another object of the invention to provide a lighting fixture which is capable of producing a substantially white light which can be selectively color shaded.

Briefly, the invention provides a lighting fixture which is comprised of a housing, a first array of electronic lamps mounted in the housing for emitting a first colored light, a second array of electronic lamps mounted in the housing for emitting a second colored light, and means such as a rheostat connected to at least one of the arrays of lamps for adjusting the intensity of light emitted. In addition a light diffusing cover is mounted in the face of the housing over the arrays of lamps to diffuse light emitted therefrom.

In one embodiment, the arrays of lamps are connected in an alternating series arrangement and in series with the rheostat. Thus, if a certain balance is achieved between the differently colored electroni clamps so that a certain shade of light is obtained, due to the character of the lamps used as sources, the total emitted color would not materially change if by means of the rheostat the group as a whole is dimmed down. In this embodiment, the amount of differently colored light, e.g. red and green light which is emitted can be controlled via the rheostat from time to time.

In another embodiment, each array of lamps is disposed in a ring which is in concentric relation to the other array of lamps. Further, each array is provided with a rheostat which is connected in series to the array. In this embodiment, each rheostat can be used to control the respective ring of colored lamps so as to adjust the light emitted therefrom. For example, where the colored lamps are either red or green, more red light can be emitted at one time or more green light can be emitted at another time. Thus, in order to avoid a reduction in acuity of vision at night, more red light can be made available. For other purposes, many other colors and shades including white are available with a minimum production of heat and energy in the infra red range by the use of electronic lights such as light emitting diodes.

By the use of a rheostat in series with both groups of colored lamps and their rheostats, once a desired balance is obtained, the intensity overall can be chaged without materially changing the color of the overall light output.

In either embodiment, a panel can be positioned in the housing to mount the arrays of lamps therein. Further, the panel can be provided with a plurality of reflector surfaces, each of which is disposed about a respective lamp to reflect light therefrom.

In still another embodiment, the lighting fixture can be provided with an incandescent lamp in the housing for emitting incandescent white light. As above, a rheostat is connected in series with the incandescent lamp in order to control the intensity of light emitted therefrom. This fixture can be used to emit only white light or white light with shadings of red or green or both depending upon the color of light to be emitted.

Further, the composite lighting fixture may also have a master on-off switch connected to the various lamps in order to selectively actuate the fixture.

Of note, the lighting fixture can be used without a supplemental incandescent lamp even if higher intensities are required by simply adding additional arrays or rings of electronic lamps.

In place of incorporating multiple colors of electronic lamps e.g. in a reading lamp, one color of such lamps can be useful for certain purposes. Thus, red or green may be used alone for certain color emphasis or for limiting of infra red emission or heat.

Where an incandescent lamp is not used and where additional electronic lights are used, the lighting fixture may be made quite small and may use little energy.

These and other objects and advantages of the invention will become more apparent from the following detailed description taken in conjunction with the accompanying drawings wherein:

FIG. 1 illustrates a perspective view of a reading lamp constructed in accordance with the invention;

FIG. 2 illustrates a part cross-sectional side view of the reading lamp of FIG. 1;

FIG. 3 illustrates an end view of the lamp of FIG. 1;

FIG. 4 illustrates an enlarged view of a reflector surface of the lamp of FIG. 1 in accordance with the invention;

Figure 7:
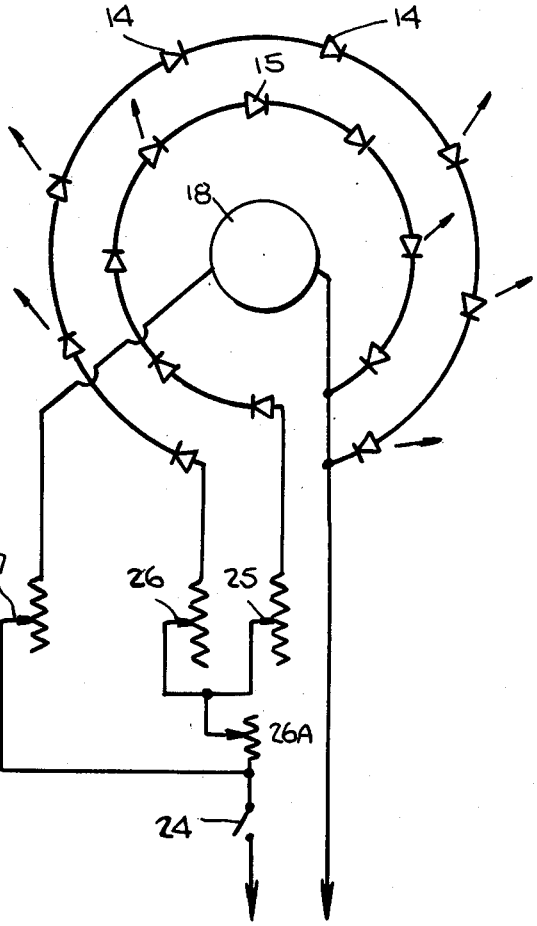
Figure 8:
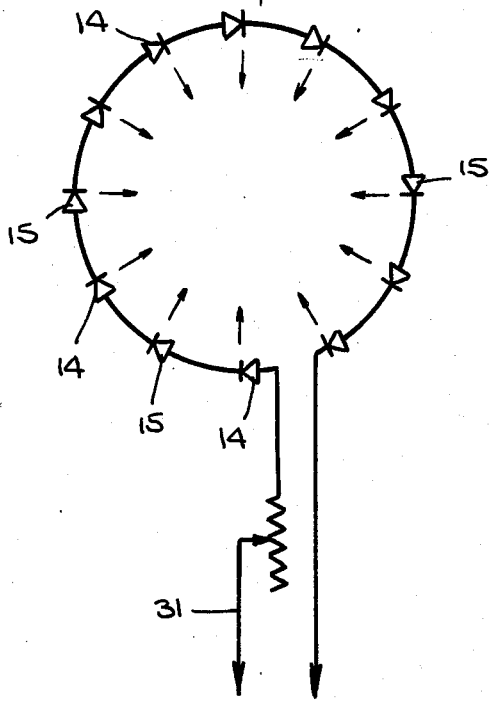

FIG. 7 diagrammatically illustrates an electrical circuit for a lamp as shown in FIG. 1; and FIG. 8 diagrammatically illustrates a circuit for a modified lamp in accordance with the invention.

Referring to FIG. 1, a lighting fixture, for example in the form of a reading lamp 10 includes a housing 11 of cylindrical or barrel shape which is mounted on a fitting 12 so as to receive an extension arm (not shown) or other suitable mounting means. As shown in FIGS. 1 and 2, the housing 11 has an open face within which a panel 13 of annular shape is mounted. This panel 13 carries two arrays of electronic lamps 14, 15 for emitting colored light from the open face of the housing 11. One array of electronic lamps 14 emits a colored light such as red light while the other array of lamps 15 emits light of a complementary color, for example green. As shown in FIG. 3, the electronic lamps 14, 15 are arrayed in alternating manner in a circular pattern within the housing 11. In addition, the panel 13 has an aperture 16 for purposes as explained below.

Referring to FIG. 2, the panel 13 includes a plurality of reflector surfaces 17 each of which (see FIG. 4) is disposed about a respective electronic lamp 14, 15 to reflect light therefrom.

Referring to FIG. 2, the reading lamp 10 also has an incandescent lamp 18 mounted in the housing 11 on a suitable mounting means in order to emit incandescent white light through the aperture 16 in the panel 13. As indicated, the mounting means 19 includes a suitable socket 20 in which the incandescent lamp 18 is inserted and a bracket 21 for mounting the socket 20 on the interior of the housing 11. Also, the incandescent lamp 18 is aligned on the axis of the housing 11 coaxially of the panel 13 and of the electronic lamps 14, 15.

Referring to FIGS. 1 and 2, the reading lamp 10 has a light diffusing cover 22 mounted in the face of the housing 11 over the arrays of electronic lamps 14, 15 in order to diffuse light emitted from the electronic lamps 14, 15 and incandescent lamp 18.

As shown in FIG. 2, a power cord 23 is provided to deliver power to the reading lamp 10 from a suitable source and is connected to the lamps 14, 15, 18 in suitable manner vis a master on-off slide switch 24. In addition, four switch rheostats 25, 26, 26A, 27 are provided to individually control the respective arrays of electronic lamps 14, 15 and the incandescent lamp 18. As indicated in FIG. 7, one rheostat 26 is connected in series to the array of red electronic lamps 14, a second rheostat 25 is connected in series to the array of green electronic lamps 15 and a third rheostat 26A controls both arrays of electronic lamps 14, 15. The fourth rheostat 27 is connected in series to the incandescent lamp 18. In this case, the similar colored electronic lamps 14, (15) are connected in series and wired to their own respective switch rheostats 26, (25) while being connected in parallel with the rheostat 26A. In this manner, the three rheostates 25, 26, 26A constitute a means to control the intensity of light emitted from each array of lamps 14, 15 while permitting simultaneous emission of light from each array of lamps 14, 15.

In use, if only incandescent white light is required, the master switch 24 is turned on and the switch rheostat 27 for the incandescent lamp 18 is turned on together with the switch rheostat 26A. The intensity of the emitted white light can then be changed from time to time by adjustment of the rheostat 27, for example by turning.

Should a different shade of white light be desired, the switch rheostat 26 (25) for the one of the arrays of electronic lamps 14 (15) can be turned on. For example, turning on of the switch rheostat 26 for the red electronic lamps 14 permits the introduction of a reddish shade to the white light. Conversely, actuation of the switch rheostat 25 for the green electronic lamps 15 permits a greenish shade of the white light. Of course, actuation of both the red and green electronic lamps 14, 15 permits different shadings to be made on the emitted white light.

By shading the light emitted from the incandescent lamp 18 which may be of high intensity, the amount of glare from any sheen on an illuminated surface such as a magazine or glossy surface due to filament intensity may be reduced or substantially eliminated.

Of note, dimming of the incandescent lamp 18 where higher intensity light is not required, results in an inherent change in color of the light as well as a relative increase in the amount of heat and infra-red energy. This is, however, not true for the electronic lamps 14, 15 where color is substantially constant and does not change with dimming. Hence, balance can be maintained even when these colors are mixed to obtain a specific blend with both being dimmed together. Thus, by the use of the rheostat 26A, the light emitted by the combined lamps can be dimmed maintaining the shade obtained by the use of the rheostats 25, 26. Also, for reading in close quarters, the incandescent lamp 18 need not be used since the electronic lamps 14, 15 can be used to provide the required intensity. This avoids an increase in heat and infra-red energy.

Further, where the lighting fixture is constructed for use as a desk or cockpit light, the light output can be changed from time to time without the need for filters and the resultant loss of energy and production of heat. In this case, the respective rheostats permit the control of white light with a continuous spectrum as well as colored red and green light and a white light made by combining these two colors in proper amounts.

Figure 5:
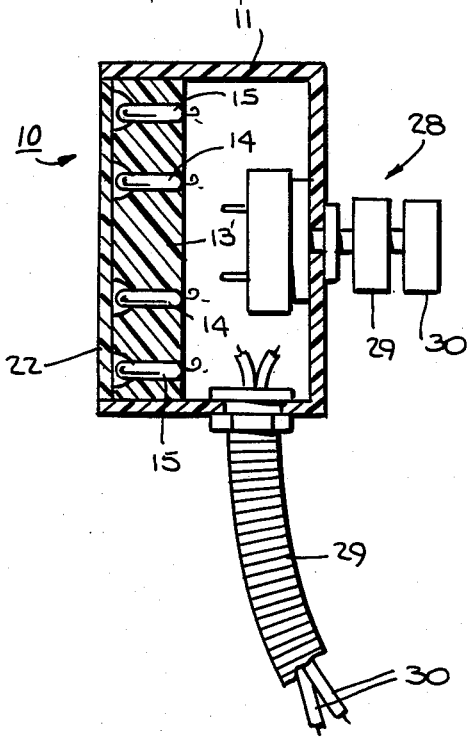
FIG. 5 illustrates a cross-sectional view of a modified lamp in accordance with the invention.
Figure 6:
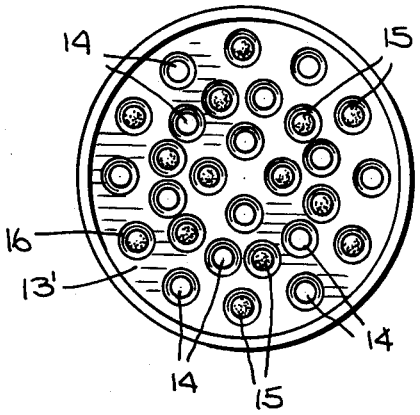
FIG. 6 illustrates an end view of the lamp of FIG. 5.

Referring to FIG. 5, wherein like reference characters indicate like parts as above, the lighting fixture 10' can be constructed without an incandescent lamp. In this case, the housing 11 can be shortened and the panel 13' can be formed as a disc and provided with a larger number of electronic lamps 14, 15. As indicated in FIG. 6, the electronic lamps 14, 15 can be arranged in three concentric rings with each ring containing lamps of alternating color.

Further, as indicated in FIG. 5, the fixture 10' may be provided with a switch rheostat 28 in the form of a double level control with dual knobs 29, 30 with each level controlling a separate color. Further, a flexible metallic arm 29 can be used to supply both mounting and conduit for the electrical wires 30 of the fixture 10'.

Alternatively, instead of using a single panel 13', individual reflectors and mounts (not shown) can be provided for the individual electronic lamps.

In use, the fixture 10' may provide red of green light or a white light by mixing of these two complementary colors.

Referring to FIG. 8, in another embodiment, an array of colored electronic lamps having an alternating sequence of differently colored lamps can be connected in series to a single switch rheostat 31.

Where described as connected in series, parallel connection may be used when the voltage supply so warrants.

The invention thus provides a lighting fixture which offers a wide variety of colors as well as shades of white without using filters. The lighting fixture may also operate with high efficiency and little emission of heat or infra-red energy.

The invention also provides a lamp which offers the facilitity of producing white light with the option of changing the shades of color produced. The invention also provides a lamp which is capable of producing multiple colors of light at selected intensities. By proper selection of the colors, a desired balance can be obtained. Due to the character of the electronic lamps which generally would be light emitting diodes, the total color of the light emitted would not materially change even when both are dimmed by a rheostat.

The lamp can be used as a reading lamp and can be made of relatively small compact dimensions. Further, the lamp can be mounted on suitable mounting arrangements so as to provide for a variety of uses, for example as a desk lamp, reading lamp, cockpit lamp and the like.

The lamp can be used to provide better color discrimination as may be required in the reading of a multicolor map or examination of biological tissue. In such cases, the red and green lamps could be used in combination to illuminate the area.

What is claimed is:

1. A reading lamp for illuminating a surface comprising a housing;

a first array of electronic lamps mounted in said housing for emitting a first colored light;

a second array of electronic lamps mounted in said housing for emitting a second colored light; and means connected to said arrays of lamps to control the intensity of light emitted from each array while permitting simultaneous emission of light from each array.

2. A reading lamp as set forth in claim 1 wherein said first array of lams and said second array of lamps are connected in an alternating series arrangement and in series with said means.

3. A reading lamp as set forth in claim 1 wherein said first array of lamps emit red light and said second array of lamps emit green light.

4. A reading lamp as set forth in claim 1 which further comprises a light diffusing cover mounted in said housing over said lamps to diffuse light emitted therefrom.

5. A reading lamps as set forth in claim 1 wherein each said array of lamps is disposed in a ring and in concentric relation to the other of said array of lamps.

6. A reading lamp as set forth in claim 5 wherein said means includes a first rheostat connected in series to one of said arrays and a second rheostat connected in series with the other of said arrays.

7. A reading lamp as set forth in claim 1 which further comprises a panel in said housing mounting said arrays of lamps therein.

8. A reading lamp as set forth in claim 7 wherein said panel includes a plurality of reflector surfaces, each said surface being disposed about a respective lamp to reflect light therefrom.

9. A reading lamp as set forth in claim 1 further comprising an incandescent lamp in said housing for emitting incandescent white light.

10. A reading lamp as set forth in claim 9 further comprising a rheostat connected in series with said incandescent lamp to control the intensity of light emitted therefrom.

11. A reading lamp as set forth in claim 10 further comprising a master on-off switch connected to said arrays of lamps and said incandescent lamp to selectively actuate said arrays of lamps and said incandescent lamp simultaneously.

12. A lighting fixture comprising a housing having an open face;

an incandescent lamp mounted in said housing for emitting incandescent light from said face;

a first switch rheostat connected in series with said lamp to control the intensity of emitted light;

a first array of electronic lamps mounted in said housing for emitting red light from said face;

a second switch rheostat connected in series with said first array to control the intensity of emitted red light;

a second array of electronic lamps mounted in said housing for emitting green light from said face; and a third switch rheostat connected in series with said second array to control the intensity of green light.

13. A lighting fixture as set forth in claim 12 which further comprises a master on-off switch connected to said rheostats to simultaneously actuate said lamps.

14. A lighting fixture as set forth in claim 12 which further comprises a light diffusing cover mounted in said face of said housing over said lamps to diffuse light emitted therefrom.

15. A lighting fixture as set forth in claim 12 wherein each array is a ring concentric to said incandescent lamp.

16. A lighting fixture as set forth in claim 12 wherein each array is a ring concentric to said incandescent lamp and to the other array.

17. A lighting fixture as set forth in claim 12 which further comprises an adjustable mount mounting said housing thereon.

18. A lighting fixture comprising a housing having an open face;

an incandescent lamp mounted in said housing for emitting incandescent light from said face;

a first switch rheostat connected in series with said lamp to control the intensity of emitted light;

a first array of electronic lamps mounted in said housing for emitting colored light from said face; and a second switch rheostat connected in series with said first array to control the intensity of emitted colored light.

19. A reading lamp for illuminating a surface comprising a housing having an open face;

a first array of electronc lamps mounted in said housing for emitting red light from said face;

a first rheostat connected in series with said first array to control the intensity of emitted red light;

a second array of electronic lamps mounted in said housing for emitting green light from said face;

a second rheostat connected in series with said second array to control the intensity of green light; and a third rheostat connected in series with said first and said second rheostats to simultaneously control said first and said second rheostats.

20. A reading lamp for illuminating a surface comprising a housing having an open face;

an array of electronic lamps mounted in said housing for emitting light from said face to illuminate the surface;

means connected with said array to control the intensity of light emitted onto the surface; and a light diffusing cover mounted in said face of said housing over said lamps to diffuse light emitted therefrom.

21. A lighting fixture comprising a housing;

an incandescent lamp mounted in said housing for emitting incandescent light therefrom; and at least one array of electronic lamps mounted in said housing for emitting colored light therefrom to provide color discrimination for reading multicolor materials.

22. A lighting fixture as set forth in claim 21 which further comprises means connected in series with said incandescent lamp to control the intensity of emitted light.

23. A lighting fixture as set forth in claim 21 which further comprises means connected in series with said array of electronic lamps to control the intensity of light emitted.

* * * * *

UNITED STATES PATENT AND TRADEMARK OFFICE

CERTIFICATE OF CORRECTION

PATENT NO. : 4,677,533

DATED : June 30, 1987

INVENTOR(S) : Julian A. McDermott

It is certified that error appears in the above-identified patent and that said Letters Patent is hereby corrected as shown below:

olumn 1, line 28 "inventiont o" should be -invention to-
olumn 1, line 35 "inventionto" should be -invention to-
olumn 1, line 54 "electroni clamps" should be -electronic --lamps--.
olumn 2, line 12 "chaged" should be -changed-
olumn 4, line 48 "of" should be -or-
olumn 5, line 28 "lams" should be -lamps-
olumn 5, line 37 "lamps" should be -lamp-
olumn 6, line 40 "electronc" should be -electronic- Signed and Sealed this Eighth Day of March, 1988

*Attest:*

*Attesting Officer*

DONALD J. QUIGG

*Commissioner of Patents and Trademarks*